US010259695B2

(12) United States Patent
Pontano et al.

(10) Patent No.: US 10,259,695 B2
(45) Date of Patent: Apr. 16, 2019

(54) MATCH CASE WITH INTEGRATED UTILITY FEATURES

(71) Applicant: Industrial Revolution, Inc., Tukwila, WA (US)

(72) Inventors: Peter Pontano, Seattle, WA (US); Graeme Esarey, Seattle, WA (US); Brendan Lake, Hong Kong (HK); Karrol Siasico, Hong Kong (HK)

(73) Assignee: Industrial Revolution, Inc., Tukwila, WA (US)

( * ) Notice: Subject to any disclaimer, the term of this patent is extended or adjusted under 35 U.S.C. 154(b) by 0 days.

(21) Appl. No.: 15/397,724

(22) Filed: Jan. 3, 2017

(65) Prior Publication Data

US 2017/0231272 A1 Aug. 17, 2017

Related U.S. Application Data

(60) Provisional application No. 62/274,335, filed on Jan. 3, 2016.

(51) Int. Cl.

| | |
|---|---|
| ***A24F 29/00*** | (2006.01) |
| ***A24F 27/00*** | (2006.01) |
| ***F21V 33/00*** | (2006.01) |
| ***F21V 21/088*** | (2006.01) |
| ***B67B 7/16*** | (2006.01) |
| ***B65D 41/04*** | (2006.01) |
| *B65D 51/24* | (2006.01) |

(52) U.S. Cl.

CPC ..... *B67B 7/16* (2013.01); *A24F 27/00* (2013.01); *A24F 29/00* (2013.01); *F21V 21/0885* (2013.01); *F21V 33/0084* (2013.01); *B65D 51/248* (2013.01)

(58) Field of Classification Search

CPC ..... A24F 29/00; A24F 27/00; A24F 27/10; B67B 7/16; F21V 21/0885; F21V 33/0084; B65D 51/248

USPC ..... 206/101, 38, 234, 236

See application file for complete search history.

(56) References Cited

U.S. PATENT DOCUMENTS

| | | | | | |
|---|---|---|---|---|---|
| 2,086,839 | A | * | 7/1937 | Arce | A24F 15/18 206/38 |
| 4,560,344 | A | * | 12/1985 | Kietaibl | F23Q 2/32 431/253 |
| 4,854,856 | A | * | 8/1989 | Steiger, Jr. | B67B 7/16 131/185 |
| 5,313,376 | A | * | 5/1994 | McIntosh | F21V 33/0084 362/119 |
| D485,431 | S | * | 1/2004 | Hsu | D3/210 |
| D660,487 | S | * | 5/2012 | Wu | D26/38 |
| D686,475 | S | * | 7/2013 | Wu | D3/210 |
| 8,584,842 | B2 | * | 11/2013 | Fakhouri | A24F 9/04 206/236 |
| D710,537 | S | | 8/2014 | Jackson et al. | |

(Continued)

*Primary Examiner* — Andrew D Perreault

(74) *Attorney, Agent, or Firm* — DWC Law Firm, P.S.; David Chen

(57) ABSTRACT

Integrated utility devices are disclosed having a myriad of synergistic features. A body having an internal storage cavity may be sealed by a cap comprising a self-contained flashlight assembly. Also, hook attached to the body may serve dual purposes of providing a bracing surface for a bottle opener and a hook portion for a gated carrying clip for the body having internal storage cavity.

6 Claims, 3 Drawing Sheets

(56) References Cited

U.S. PATENT DOCUMENTS

2010/0085739 A1* 4/2010 Webb ..... B26B 1/02
362/157

* cited by examiner

MATCH CASE WITH INTEGRATED UTILITY FEATURES

CROSS REFERENCE TO RELATED APPLICATION(S)

This application claims the benefit of U.S. provisional patent application Ser. No. 62/274,335 (filed Jan. 3, 2016) which is incorporated herein by reference in its entirety.

BACKGROUND

1. Technical Field

The present disclosure relates to integrated utility device having multiple uses particularly suited for outdoor activities.

2. Description of Related Art

Preparing for outdoor activities such as, for example, camping, can require a myriad of tools and/or equipment for an enjoyable experience. A combination integrated utility device that combines features in an effective and synergistic manner can offer much needed convenience and efficiency.

BRIEF SUMMARY

In some embodiments of the present disclosure, an integrated utility device comprises a body having a cavity for storing items. A cap is removably coupled to the body and seals an opening of the cavity, and the cap contains a light source.

In some embodiments, the integrated utility device comprises a body having an internal cavity containing matches. A carrying clip is attached to body and a bottle opener comprises a bracing surface of the clip for use in bracing a top portion of a bottle cap attached to a bottle and a protrusion member disposed adjacent the clip for use in abutting a bottom edge of the bottle cap while the utility device is pivoted relative to the bottle cap.

DETAILED DESCRIPTION

In the present description, where used, the terms "about" and "consisting essentially of" mean±20% of the indicated range, value, or structure, unless otherwise indicated. It should be understood that the terms "a" and "an" as used herein refer to "one or more" of the enumerated components. The use of the alternative (e.g., "or") should be understood to mean either one, both, or any combination thereof of the alternatives, unless expressly stated otherwise. As used herein, the terms "include" and "comprise" are used synonymously, and those terms and variants thereof are intended to be construed in a non-limiting, open sense.

In the following description, certain specific details are set forth in order to provide a thorough understanding of various embodiments of the present disclosure. However, upon reviewing this disclosure, one skilled in the art will understand that the invention may be practiced without many of these details. In other instances, well-known or widely available materials of construction or structures associated with electric (e.g., LED) flashlights, matches, consumer products, etc., have not been described in detail to avoid unnecessarily obscuring the descriptions of the embodiments of the present disclosure.

FIGS. 1-4 show an example embodiment of the integrated utility device 2 of the present disclosure, which can be a combination match case, flashlight, bottle opener, and carry hook with spring loaded gate.

Figure 1:
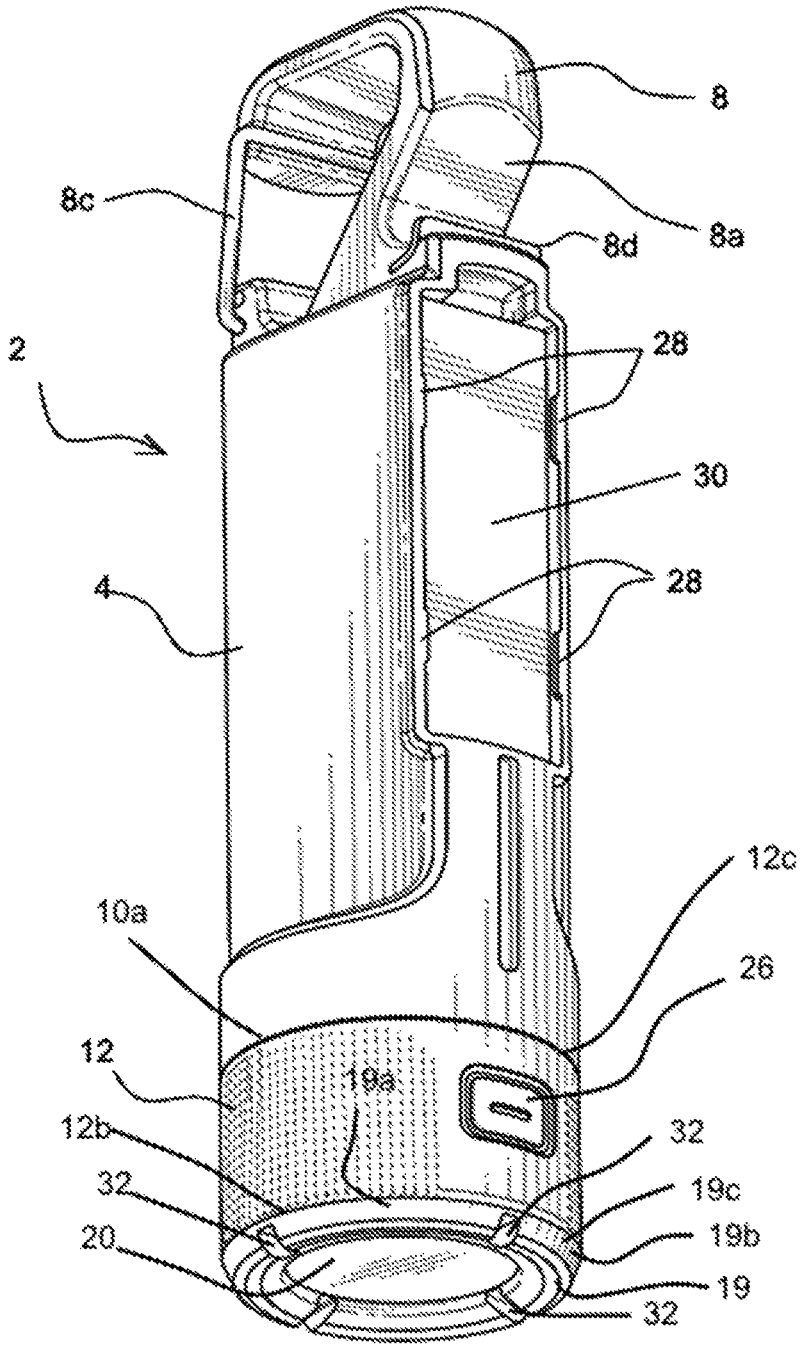
FIG. 1 is a perspective view showing an embodiment of an integrated utility device of the present disclosure, which can be a combination flash light, match case, and bottle opener with carrying clip comprising a hook and spring-loaded gate.
Figure 2:
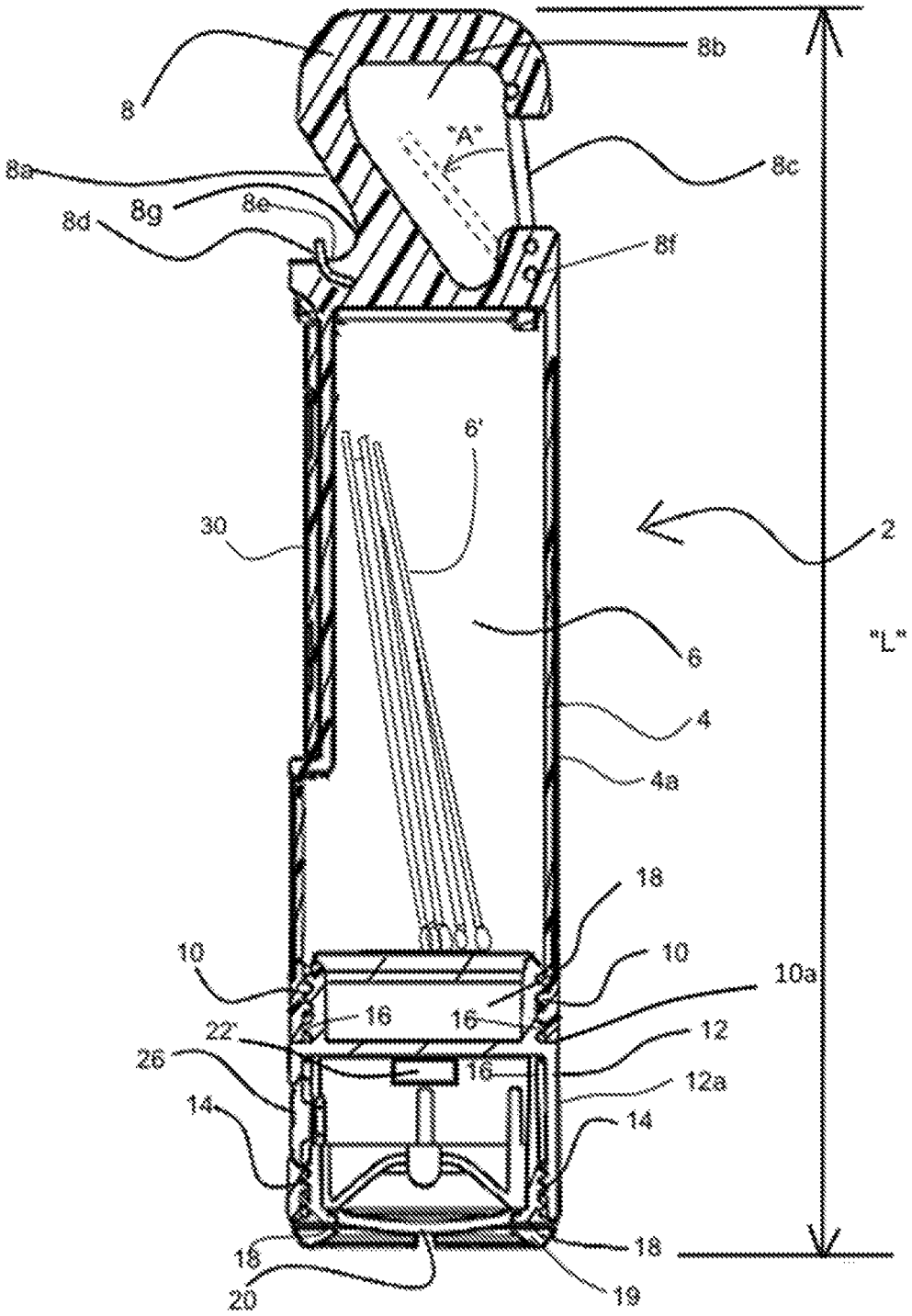
FIG. 2 is a side cross sectional view of the integrated utility device of FIG. 1.

Referring to FIGS. 1 and 2, in some embodiments, the utility device 2 includes a main body 4, having a main body outer wall 4*a*, with a cavity 6 formed within the wall. In some embodiments, the wall 4*a* can be approximately cylindrical in shape, enclosing the cavity 6 therein. The cavity 6 can be used for storing items for transportation and/or keeping, such as, for example, match sticks 6', or other items that may require shelter from moisture or other elements.

The body 4 can have a rim 10*a* at a first end portion thereof, defining an opening of the cavity 6. Also, a cap 12 can be releasably coupled to the rim 10*a* to seal the cavity 6. The cap 12 can be shaped as a cylinder, which can be shorter in length than the body 4 in some embodiments. For example, in some embodiments, the body 4 can include an internally threaded portion 10 proximate the rim 10*a*, and the cap 12 can include a generally cylindrically shaped perimeter cap wall 12*a*, having an external threaded portion 16 proximate a first end portion of the cap 12. The respective threaded portions 10, 16 of the body 4 and cap 12 may be configured such that the threaded portion 16 of the cap 12 can function as a female threaded portion to releasably mate with the threaded portion 10 of the body 4 functional as a male threaded portion.

Figure 3:
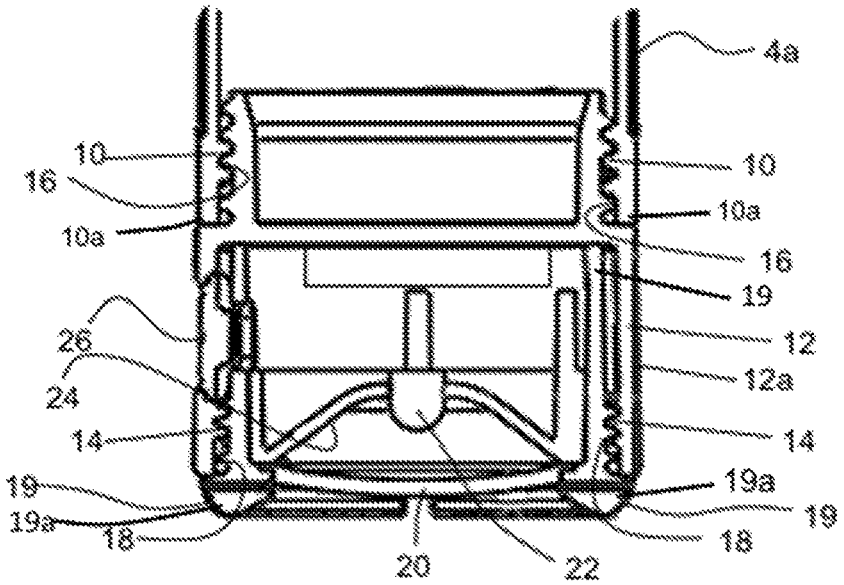
FIG. 3 is an enlarged partial cross sectional view of a bottom portion of the integrated utility device of FIG. 2.

Referring to FIG. 3, in some embodiments, the cap 12 can include a flashlight assembly comprising a lens 20 on a second (or outer) end portion of the cap 12, a bulb or LED light source 22 contained behind the lens 20, an electrical power supply 22' (e.g., battery), a reflector surface 24 proximate the light source 22, and a switch 26 for actuating power to the light source 22 (e.g., selectively completing or breaking a circuit). Moreover, the lens 20, light source 22 and reflector surface 24 can be fixedly coupled to an annular retaining member 19, and the annular retaining member 19 can be selectively removed or connected to, the cap 12 (e.g., to unscrew the various flashlight components to access a battery within the cap 12 to replace the battery). That is, in some embodiments, the annular retaining member 19 can include external threads 18 configured to mate with internal threads 14 of the cap 12, for use in selectively attaching and detaching the annular retaining member 19 to or from the cap 12.

Moreover, in some embodiments, an end portion 19*a* of the annular retaining member 19 protrudes past an end 12*b* of the cap 12. See, e.g., FIG. 1. The end portion 19*a* can include an outer perimeter wall 19*b* having ribs 19*c* disposed thereon for aiding a user in gripping the outer perimeter wall 19*b* to selectively turn the annular retaining member 19 relative to the cap 12, to unscrew the retaining member 19 from the cap 12 via threads 14, 18, or to attach the retaining member 19 to the cap 12. In some embodiments, the end portion 19*a* further includes notches 32, which can be formed on the end portion 19*a* receding in an axial direction into the end portion 19*a*. The notches 32 can receive a rigid tool to aid a user in turning the end portion 19*a*, and hence the annular retaining member 19, as will be appreciated by those skilled in the art upon reviewing this disclosure.

In some embodiments, the cap 12 can thus operate as a flashlight when attached to the body 4, as a user can actuate the light source 22 by selectably depressing the switch 26, and in some embodiments, the cap 12 can operate as a flashlight when removed from the body 4, as well as when attached to the body 4, as the flashlight assembly as described above can be entirely contained within the cap 12.

Referring again to FIGS. 1 & 2, in some embodiments, a match strike pad 30 is removably attached to the main body 4. That is, for example, a flat surface portion can be formed on the outer wall 4*a*, with holding tabs 28 formed at edges thereof extending over the flat surface. A replaceable match strike pad 30 can be configured to fit over the flat surface and can be retained by the holding tabs 28.

In some embodiments, a second end portion of the body 4, opposite the cap 12 and rim 10*a*, can be integrally formed with a clip comprising an axially outwardly extending hook 8 and spring-loaded gate 8*c*. As best seen in FIGS. 1 and 2, the hook 8 and gate 8*c* define a closed loop with an interior portion 8*b*, when the spring-loaded gate 8*c* is biased in a closed position (shown in FIG. 2 in solid line). However, a user can manually force the gate 8*c* to pivot against a spring force to pivotably open the gate 8*c* in the direction of arrow "A" in FIG. 2. When the user-applied tension on the spring-loaded gate 8*c* is released, the gate 8*c* automatically returns to the closed loop position. As such, a secure clip is provided.

In some embodiments, a backside surface portion 8*a* of the hook 8 slants laterally inward toward a base of the hook 8 and joins a laterally outwardly extending wall surface 8*e*. The wall surface 8*e* extends laterally outward from a base portion 8*g* of the hook 8. Also, an axially extending protrusion member 8*d* protrudes in an axially outward direction away from the wall surface 8*e*. In some embodiments, an interior portion of the protrusion member 8*d* is embedded in material defining the wall surface 8*e* (which can be, for example, a plastic), and the embedded portion can bent laterally inward relative to a portion thereof that protrudes axially outward from the wall surface 8*e*. In some embodiments, the protrusion member is stainless steel or other formable durable material capable of long term use in the bottle opening function described herein.

Figure 4:
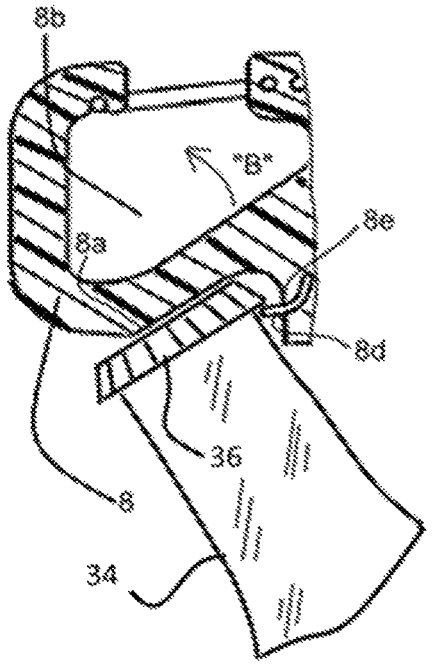
FIG. 4 is an enlarge partial cross sectional view of the top portion of the integrated utility device of FIG. 2, further showing a bottle cap attached to an unopened bottle, with the bottle cap tucked beneath a backside bracing surface of the carrying hook with an edge thereof resting against a bottle opener protrusion member.

As best seen in FIG. 4, in some embodiments, a user can brace a bottle cap 36 of an unopened bottle 34 against the backside bracing surface 8*a* of the hook 8 with a bottom edge of the cap 36 rested against the protrusion member 8*d* and disposed between the backside surface 8*a* and the protrusion member. Thereafter, a user can manually pivot the hook 8 relative to the bottle cap 36 generally in the direction of arrow "B" as shown in FIG. 4, to remove the cap 36, as will be appreciated by those skilled in the art after reviewing this disclosure.

In some embodiments, an O-ring can be provided on the cap 12 and/or body 4 to keep the cavity 6 waterproof and the match strike pad can also be moved if necessary into the cavity. Also, if needed, the cap 12 is a self-contained flashlight can be removed and used separate from the body 4.

In some embodiments, the integrated utility device 2 has an axial length "L" as shown in FIG. 2. In some embodiments, the overall axial length "L" as measure from the top of the hook 8 to the bottom surface of the annular retaining member 19 can be between about 5 to about 8 inches, or longer or shorter, in other embodiments. Also, in some embodiments, a maximum width of the integrated utility device 2 can be between about 2 inches to about 4 inches, or wider or more narrow in other embodiments. In some embodiments, a maximum axial length of the cavity 6 is greater than a maximum axial length of the cap 12. In some embodiments, the maximum axial length of the cap 12 is less than one half (½), or about one half (½), of a maximum axial length of the cavity 6.

Some embodiments of the present disclosure comprise methods for using an integrated utility device comprising storing matches in a cavity 6 of a body 4 and sealing an access opening to the cavity 6 with a removable cap 12 containing a self-contained flashlight assembly that is operable attached to the body, as well as detached from the body 4. The methods also include opening a bottle by bracing a bottle cap against a carry clip having a spring-loaded gate, and abutting a portion of the bottle cap against a protrusion member extending from a wall of the body adjacent the carrying clip, and then pivoting the integrated utility device relative to the bottle cap.

After reviewing the present disclosure, an individual of ordinary skill in the art will immediately appreciate that some details and features can be added, removed and/or changed without deviating from the spirit of the invention. Reference throughout this specification to "one embodiment," "an embodiment," or "some embodiments," means that a particular feature, structure or characteristic described in connection with the embodiment(s) is included in at least one or some embodiment(s), but not necessarily all embodiments, such that the references do not necessarily refer to the same embodiment (s). Furthermore, the particular features, structures, or characteristics may be combined in any suitable manner in one or more embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. An integrated utility device comprising:

a body having an axial length and including a cavity for storing items;

a cap removably coupled to a first end portion of the body and sealing an opening of the cavity, the cap containing a light source and a battery, and wherein the cavity has an unoccupied space with an axial length at least as great as an axial length of the cap and a lateral width at least as great as half of a lateral width of the cap, when the cap is removably coupled to the body;

a carrying clip formed on a second end portion of the body, the carrying clip comprising a hook with a spring-loaded gate attached thereto, wherein the hook includes a slanted outside wall surface that slants laterally inward starting from an axially outward position to an axially inward position relative thereto, to join a laterally outwardly extending wall surface of the body that extends laterally outward from a base portion of the hook, the laterally outwardly extending wall surface having an axially outwardly extending protrusion member; and whereby the slanted outside wall surface and axially outwardly extending protrusion member are usable in combination for removing a bottle cap from a capped bottle by bracing a top portion of the bottle cap against the slanted outside wall surface while abutting an edge of the bottle cap against the axially outwardly extending protrusion member then manually pivoting the capped bottle or the body relative to one another.

2. The utility device of claim 1 wherein the cap is removably coupled to the body by being threadedly mated to the body.

3. The utility device of claim 1 further comprising a lens, and wherein a retaining member is removably coupled to the cap, and the lens and light source are fixedly attached to the retaining member.

4. The utility device of claim 3 wherein the retaining member protrudes axially past a bottom edge of the cap.

5. The utility device of claim 1 further comprising match sticks contained within the cavity.

6. The utility device of claim 5 further comprising a match striker pad attached to the body.

* * * * *